US012702183B2

(12) United States Patent
Lewis et al.

(10) Patent No.: US 12,702,183 B2
(45) Date of Patent: Aug. 11, 2026

(54) FLEXIBLE PUNCTURE RESISTANT FOOTWEAR

(71) Applicant: DRAGONSKIN LLC, San Bernardino, CA (US)

(72) Inventors: Randall Lewis, Escondido, CA (US); Boulos Haddad, San Bernardino, CA (US); Michael Bagherpour, Sunnyvale, CA (US)

(73) Assignee: DragonSkin LLC, San Bernardino, CA (US)

( * ) Notice: Subject to any disclaimer, the term of this patent is extended or adjusted under 35 U.S.C. 154(b) by 57 days.

(21) Appl. No.: 17/938,644

(22) Filed: Oct. 6, 2022

(65) Prior Publication Data

US 2023/0104869 A1 Apr. 6, 2023

Related U.S. Application Data

(60) Provisional application No. 63/252,960, filed on Oct. 6, 2021.

(51) Int. Cl.
*A43B 1/00* (2006.01)

(52) U.S. Cl.
CPC ..... *A43B 1/0018* (2013.01)

(58) Field of Classification Search
CPC ..... A43B 1/0018; A43B 7/12; A43B 7/148; A43B 7/1485; A43B 15/00; A43B 19/005; A43B 13/04; A43B 3/16
USPC ..... 36/102
See application file for complete search history.

(56) References Cited

U.S. PATENT DOCUMENTS 1,717,127 A * 6/1929 Toole ..... A43B 7/32 36/4
4,294,022 A * 10/1981 Stockli ..... A43B 5/08 36/4
4,468,870 A * 9/1984 Sternberg ..... A43B 5/008 36/130
5,266,062 A * 11/1993 Runckel ..... A63B 31/11 36/8.1
5,913,592 A * 6/1999 Moore ..... A43B 7/26 36/94
7,941,946 B2 * 5/2011 Clancy ..... A43B 13/223 36/8.1

(Continued)

OTHER PUBLICATIONS

Crack Shot Corporation; Sting Ray Guardz; sales@crackshotcorp.com; Jan. 15, 2019.

(Continued)

*Primary Examiner* — Timothy K Trieu
(74) *Attorney, Agent, or Firm* — Intelink Law Group, PC; Jonathan Kidney

(57) ABSTRACT

A flexible, protective water sport footwear has a stretchy, flexible material configured to form at least one pair of booties that covers an entirety of a person's feet and ankles when worn; and a plurality of puncture resistant, non-stretchy protective materials attached in a pattern to at least one of an inner and outer side of the at least one pair of booties, the pattern providing coverage of a majority of the person's sole, toes, and arch, wherein a comfort and flexibility of the at least one pair of booties is preserved because the pattern provides gaps being occupied by the flexible material, the gaps at least being between the person's toes and arch, and along the person's Achilles tendon.

9 Claims, 8 Drawing Sheets

(56) References Cited

U.S. PATENT DOCUMENTS

| | | | | |
|---|---|---|---|---|
| 10,299,532 | B2 * | 5/2019 | Cherosky | A43B 7/12 |
| 2015/0164177 | A1 * | 6/2015 | Hohmann | B63B 34/56 441/61 |
| 2016/0051005 | A1 * | 2/2016 | Hohmann | A43B 5/08 441/61 |

OTHER PUBLICATIONS

Zachary C. McGaugh; California State Science Fair 2013 Project Summary; What Material is Best for Lining the Inside of a Surf Bootie to Prevent Foot Penetration from a Stingray Barb? Apr. 2, 2013.

* cited by examiner

FLEXIBLE PUNCTURE RESISTANT FOOTWEAR

CROSS-REFERENCE TO RELATED APPLICATION(S)

This application claims the benefit of U.S. Provisional Patent Application No. 63/252,960, filed Oct. 6, 2021, titled "Flexible Puncture Resistant Footwear," the contents of which are hereby incorporated by reference in its entirety.

FIELD

The invention includes footwear, particularly beach and water sport footwear. In particular the invention is directed to water booties, for example, which are tailored to resist punctures from sharp underwater objects, such as stingray barbs.

BACKGROUND

Stingrays typically live on the sea floor and bury themselves in sand to hide from predators. Many species of stingrays have a serrated, venomous barb, which sits flush near the base of their tail. They use the barb to defend themselves, flailing their tail reflexively when touched.

People accidently provoke such a defensive response and frequently are stung on the foot/ankle area. Some stings are severe and result in the barb being deeply embedded in the foot. The barb is encased in a venom-filled pouch that causes extreme pain with even minor skin penetration. There is also a risk of infection, and in some cases, part of the barb may break off inside the foot. There are thousands of stingray injuries reported each year in the U.S. alone, and more worldwide. Sometimes emergency medical care is required after a sting. The stingray barb is shaped like a serrated bone needle, and goes right through most traditional textiles, such as cloth and neoprene. Typical water booties are usually made from stretchy foamed neoprene, which is easily penetrated by the stingray barb. Higher-end surfing booties contain a layer of vulcanized rubber over some areas of the base layer of neoprene, but this rubber is typically too thin (<1 mm) and does not cover enough area to provide much protection against a stingray barb. Water shoes with thicker soles provide some protection, but typically only on the sole. Additionally, the thick soles are less than ideal for many water sports, including surfing.

Similarly, there exist boots and ankle guards designed specifically to prevent stingray injury, but these products significantly limit mobility in the water. They are heavy and loosely-fitting, intended for hunters in waters that contain stingrays. Although these products do significantly reduce the chance of stingray injury, they are so bulky and drag so much in the water as to be impractical for the typical beachgoer or water sport enthusiast.

Accordingly, in view of the challenges and lack of appropriate protective water sport footwear, various stingray proof or resistant water footwear are elucidated in the following description.

SUMMARY

The following presents a simplified summary in order to provide a basic understanding of some aspects of the claimed subject matter. This summary is not an extensive overview, and is not intended to identify key/critical elements or to delineate the scope of the claimed subject matter.

Its purpose is to present some concepts in a simplified form as a prelude to the more detailed description that is presented later.

In one aspect of the disclosed embodiments, a flexible, protective water sport footwear is provided, comprising: a stretchy, flexible material configured to form at least one pair of booties that covers an entirety of a person's feet and ankles when worn; and a plurality of puncture resistant, non-stretchy protective materials attached in a pattern to at least one of an inner and outer side of the at least one pair of booties, the pattern providing coverage of a majority of the person's sole, toes, and arch, wherein a comfort and flexibility of the at least one pair of booties is preserved because the pattern provides gaps being occupied by the flexible material, the gaps at least being between the person's toes and arch, and along the person's Achilles tendon.

In another aspect of the disclosed embodiments, the above footwear is provided, wherein the pattern is applied to the outer side of the booties and comprises: a first protective material entirely surrounding the person's toes including a bottom of the toes; and a second protective material covering sides and a bottom of the person's arch from a heel side to before the person's toes, wherein a top portion of the person's arch is not covered; and/or wherein the gap along the person's Achilles tendon is occupied by a zipper; and/or further comprising a fastening strap attached to an upper portion of the at least one pair of booties; and/or wherein the pattern comprises: a first protective material is applied to the inner side of at least one pair of booties; and a second protective material is applied to the outer side of at least one pair of booties; and/or wherein two sets of bootie pairs are formed and the pattern comprises: a first protective material is applied to the outer side of a first pair of the two bootie sets; and a second protective material is applied to the outer side of a second pair of the two bootie sets, wherein the two pairs of booties are worn over each other and an overlay of the first and second protective materials provides the coverage of a majority of the person's sole, toes, and arch; and/or further comprising a fastening strap attached to a upper portion of the second pair of booties; and/or wherein an entirety of the sole is protected by the pattern; and/or wherein an entirety of a top of the arch is protected by the pattern; and/or wherein the flexible material is approximately between 1.5 mm-7 mm in thickness; and/or wherein the flexible material is made of neoprene; and/or wherein the protective materials are made of vulcanized rubber or nylon and are between 2-3 mm in thickness; and/or wherein the attachment of the protective materials is performed by applying a liquid form of the protective materials and allowing it to harden; and/or wherein the protective materials are vulcanized upon attachment; and/or wherein the pattern is applied to a more than two sets of bootie pairs; and/or wherein the protective materials in the pattern are separated from each other by the flexible material; and/or, wherein the protective materials in the pattern are layered and not fastened to one another and can move independently of one another when worn on the foot; and/or wherein protective material is attached as an insert into the booties; and/or wherein the pattern provides protection from a stingray barb foot strike.

DETAILED DESCRIPTION

Figure 1A:
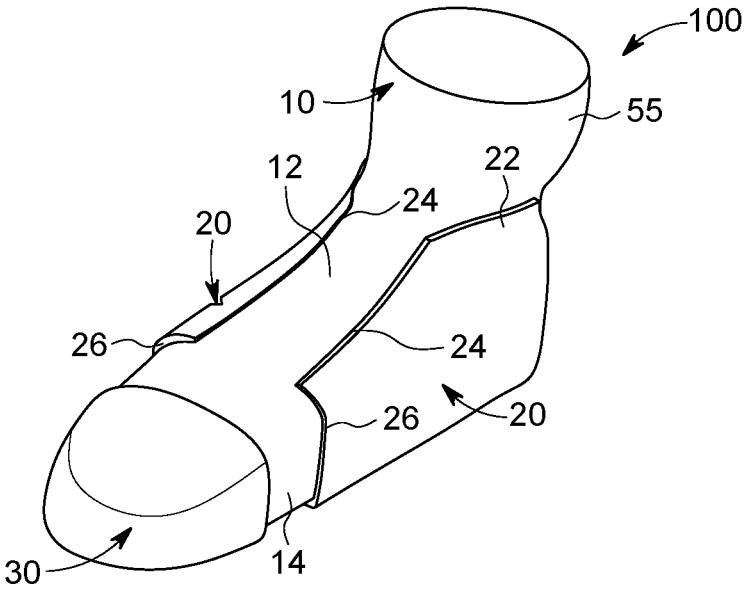
FIG. 1A is perspective view of an exemplary bootie.

It is understood that the term "booties" in this disclosure is in reference to water sport footwear, commonly worn by scuba, swimmers, surfers, surf fishers, watercraft (e.g., jet skis), etc., which at least cover the sole of the foot and up to or over the ankles, providing a covering over the entire foot and cushioning to the undersole. The nature of prior art water footwear (i.e., bootie) is that it is usually is made from a soft rubber or neoprene-like material being secured either with a zippered side or hook-loop fastened strap.

One published study described testing of various materials to line a neoprene surf bootie. See, Zachary C. McGaugh, "What Material Is Best for Lining the Inside of a Surf Bootie to Prevent Foot Penetration from a Stingray Barb?," California State Science Fair 2013 Project Summary, Project Number J2116. The abstract describes testing of ten materials as a liner for a neoprene surf bootie. The abstract identified RHINOGUARD™ as an effective liner material. The RHINOGUARD™ material is a modified fabric that is coated. The material as a full liner is less than ideal for booties as it is very expensive to produce, and not commercially available. Additionally, the material poses difficulty in adhering to neoprene and is not comfortable enough by itself to make a wearable bootie out of. The intended use of the material is glass handling, metal forming, waste management and recycling. Ocean sportwear requires better flexibility, breathability and shouldn't retain too much water.

Lombard, US Published Patent Application 20130055589 is entitled a protective aquatic shoe. The publication lacks any detailed description or illustration to accomplish the stated purposes, however. The only materials described are rubber and synthetic rubber, and the description fails to detail how such materials are used.

Bobzien WIPO Publication WO20160644091 describes stingray repellent footwear, swim goggles and a swim cap. The footwear includes magnets. The theory is that magnet elicit an aversion response from stingrays. This theory is unproven. Additionally, such footwear provides little protection, when a person steps on a buried stingray, which will sting despite any discomfort caused by the magnetic field.

One product offered as CrackShot StingRay Guardz™ is a bulky strap-on pair of protective pieces that wading shoes or boots. It is made of 1000 denier nylon fabric that encases polycarbonate inserts. This is bulky protection that significantly hinders mobility in water, and is unsuited for many water sports and activities as well as for general comfort.

In view of the prior art, it is clear that there is great need for stingray proof water footwear or "booties" that can be comfortable and useable for water sports. As such, various exemplary embodiments are described that provide flexible puncture resistant water footwear. The exemplary footwear is suited for water sports and provides the comfort and high performance of neoprene surf booties. An exemplary embodiment includes flexible and stretchy fabric, e.g., neoprene or the like, shaped as a bootie to cover the foot and a layered pattern of puncture-resistant inserts or attachments are arranged to provide stingray proof protection as well as allow comfortable fit while allowing comfortable user motion. An exemplary material for the puncture-resistant inserts or attachments is vulcanized rubber, but it is understood that other materials may be used. The exemplary pattern is set to provide protection in the areas where stingray barbs strike during a typical encounter when a wearer accidently steps on a stingray that is buried. In one or more exemplary embodiments, an applicable pattern includes a toe insert or attachment, a sole insert or attachment, and a section that wraps a side foot, and/or ankle and/or Achilles tendon. A top surface of the footwear can include gaps without the insert or attachment to retain high comfort and flexibility. The fabric of the footwear can be neoprene or similar in capability noting the fabric may not need to be entirely solid (e.g., may be like a fine mesh) or have predetermined gaps therein. A typical footwear fabric (or neoprene) can range approximately between 1.5 mm-7 mm in thickness. For a two pair embodiment, as described below, the thickness of the fabric (or neoprene) can be less, ranging approximately between 1.5 mm-4 mm in thickness.

In various exemplary embodiments, the puncture resistant inserts or attachments can be made of rubber and have a thickness of at least ~2 mm, and preferably in the range of ~2-3 mm, although this thickness may vary slightly depending on the specific type of rubber (and particularly the hardness of the formulation of the rubber). Vulcanized rubber is a preferred material, but other materials having similar hardness, flexibility, and the ability to attach to the flexible material can be used. A nonlimiting example is nylon. In prototypes, a hot glue with at thickness of ~3 mm was applied and hardened to serve as the insert(s). The glue served to be barb resistant but is less aesthetically pleasing, less flexible, and less durable than the vulcanized rubber. Vulcanized rubber works better than regular rubber because it is harder. But softer rubber can still be effective with larger thickness, e.g., in the range of approximately 4-7 mm. Generally, inserts/attachments are made thick enough to resist puncture based upon material hardness, while allowing the flexible layer to function and retain the comfort and sport properties desirable in footwear. Also, in some forms of rubber or protective material, the inserts/attachments can first be of a liquid or semi-liquid form and applied to the underlying material, and harden to the desired hardness upon curing or drying.

While the exemplary embodiments shown herein are depicted as "attachments" (or bonding to the fabric) it is understood that the equivalent functionality can be obtained by utilizing "inserts" in one or more sleeves or pockets in the underlayment, and therefore, booties that utilize inserts instead of attachments are understood to be within the scope of this disclosure.

Artisans will appreciate that other materials can be used for the inserts/attachments, so long as the material exhibits both resistance to barbs and are reasonably flexible. Traditional textiles like cloth, neoprene, even Kevlar, are unsuitable as they provide basically no protection. Hard materials like plastic or metal (imagine a credit card) provide good protection but are too inflexible. A material that can be used is cotton insulation, which is flexible and can catch a barb in its fibers. The cotton insulation should be packaged as an insert and attachment and is more difficult to incorporate than rubber. A sufficient thickness/hardness of vulcanized rubber on top of foamed neoprene has been found to be an effective solution for flexibility, durability, resistance to seawater, puncture resistance, and price.

In view of the above, an insert may be composed of layers of different materials. Also, in some embodiments, areas of the inserts/attachments may be composed of layers of differing materials, having different respective protection vs. flexibility parameters, for example. Further, the shaping of the insert (angle from plane of the insert) may vary to allow a striking barb to deflect into a preferred direction. That is, an insert/attachment may have a varying thickness, if so desired.

Generally, water footwear according to the various embodiments of this invention can be designed to include a stretchy flexible material and a protective material, affixed in an exemplary pattern to the stretchy flexible material. As a whole, the exemplary pattern permits footwear that (1) stretches to provide a close, comfortable fit and allows for user motion, while (2) greatly reducing the risk of puncture.

One possible exemplary embodiment is a stingray-resistant, water sock-bootie, composed of a stretchy flexible foamed-neoprene "sock," and a tougher patterned insert or attachment of vulcanized rubber at particular locations. The sock stretches to fit tightly against the foot, providing a comfortable fit for a range of foot shapes/sizes and limiting water ingress/drag. The pattern protects against stingray barb puncture and is specifically shaped and patterned to maximize area coverage while minimizing the effect on mobility and fit.

In an exemplary embodiment, flexible material is used as a base material to fit to the user's foot, allowing for mobility and comfort. The protective material can be bonded on a surface, for example, of the base material in a specific pattern, so as to maximize the covered area, while still allowing for comfort, mobility and fit. The flexible material also increases the standoff distance between the protective material and the user's body, thus increasing the depth a sharp object would have to puncture to cause harm. Additionally, multiple independent layers of flexible material and protective material can be layered, to further increase coverage/puncture resistance, while still allowing for flexibility and fit.

In a prototyped embodiment, rubber is vulcanized directly on top of the surface of a stretchy flexible material such as a neoprene sock, thus bonding directly to it, and helping increase its durability. The rubber is arranged in a specific pattern that maximizes coverage of the foot/ankle area, while minimally limiting mobility. The rubber almost completely prevents the stretch of the neoprene underneath and somewhat limits its flexibility. However, there are several distinct sections of rubber with gaps in between to allow the underlying neoprene to stretch and flex unhindered in particularly important areas. The sections cover a majority of the area of the foot and ankle, which the inventors have determined are the most susceptible to ray stings and constituent the risk "area." The following Figures illustrate some of the exemplary embodiments described.

FIGS. 1A-E show different views of one possible arrangement of inserts/attachments for an exemplary single layer protective bootie 100 that is sized and shaped to enclose the entire foot and optionally up to or above the ankle 55. In brief, the single-layered bootie embodiment consists of an underlying stretchy foamed neoprene bootie-sock 10, with two distinct sections of vulcanized rubber. The main rubber section 20 covers the bottom, back, and sides of the foot, with a gap down the top to allow the bootie 100 to stretch to a range of foot widths, and a half gap in the back to allow the bootie 100 to curve to fit the heel/Achilles tendon. The toe rubber section 30 covers the toes on the bottom, top, and sides, and is offset by a gap from the main rubber section 20 to allow the bootie to stretch to fit different foot lengths and allow for toe mobility. The underlying bootie is a standard stretchy neoprene surfing bootie. To manufacture the protected bootie 100, a shoe last of the appropriate size and shape can be inserted into a neoprene "sock," and the rubber can be glued onto the neoprene or vulcanized directly on top of the neoprene, thus molding to a foot shape.

Figure 1B:
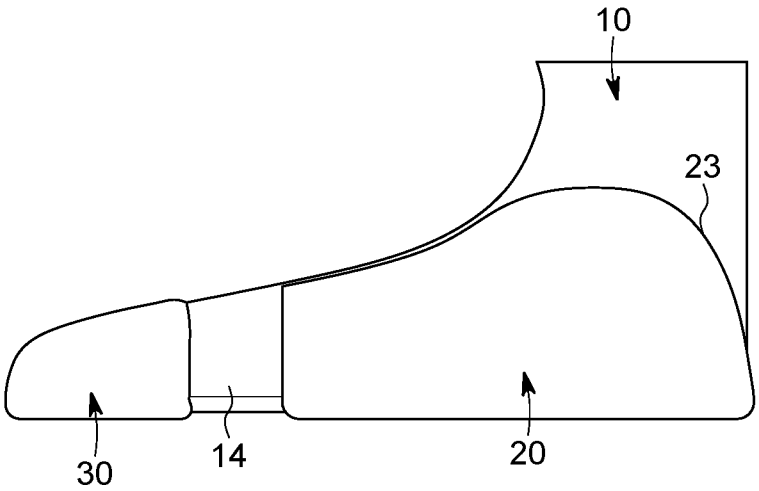
FIG. 1B is a left side view of the exemplary bootie of FIG. 1A.
Figure 1C:
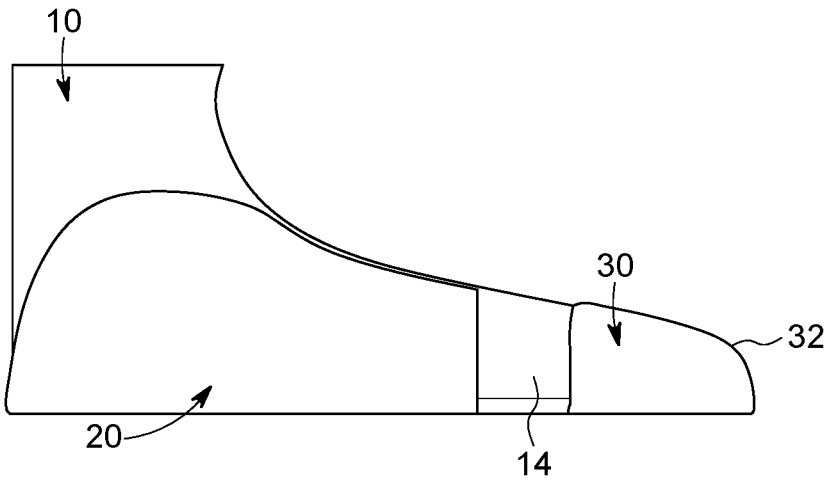
FIG. 1C is a right side view of the exemplary bootie of FIG. 1A.
Figure 1D:
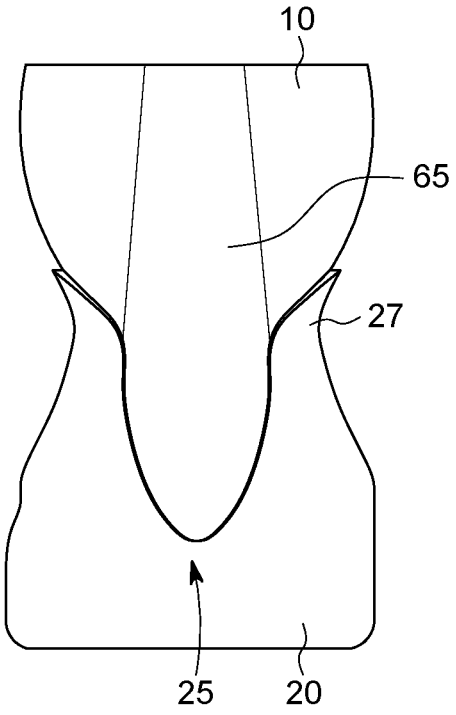
FIG. 1D is a rear view of the exemplary bootie of FIG. 1A.

FIG. 1A shows main section 20 with upper boundary 22, second boundary 24, and front boundary 26, which essentially cover the sides of the foot aft of the toes. In this embodiment, the general geometry of the main section 20 is shown to be close to a 5-sided polygon. Toe section 30 is separated by sock space 14 from main section 20 and covers the entirety of the toes, acting as a protective cap for the toes. Main section 20 does not cover the top of the foot arch 12 but is mirrored with a similar main section 20 on the opposite side of the foot (as shown in FIGS. 1B & 1C). The unprotected gap 12 in the foot arch allows looseness in the bootie 100 to facilitate putting on the bootie 100. In some embodiments, the opposing main sections 20 may be of a different shape or size due to the asymmetry in a person's foot. Nearing the upper rear of main section 20, the insert/attachment may be curved 23 with an opening 25 (FIG. 1D) at the rear allowing free movement of the Achilles 65. Not shown, but possible in various embodiments, is the inclusion of a zippered end around the Achilles 65 location, to allow for easier ingress of the foot into the bootie 100. Similarly, a zipper may be implemented in the gap 12 at the arch top, if so desired. In FIG. 1D, outward curvature 27 is provided at the upper boundary 22 to better form fit the foot's shape. Depending on how high the upper boundary 22 is, curvature 27 may not be necessary.

Figure 1E:
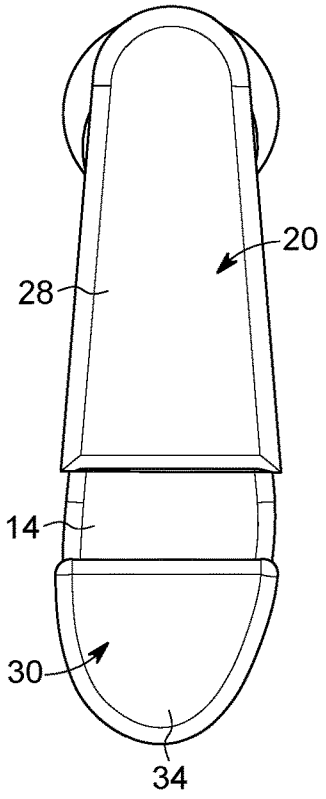
FIG. 1E is a bottom view of the exemplary bootie of FIG. 1A.

Separation 14 of the main section 20 from the toe section 30 is evident in the bottom view of FIG. 1E. The "bottom" 28 of main section 20 can be a single, integral piece with the main section(s) 20 shown in FIGS. 1A-C. However, it is possible and may be desirable to have the bottom 28 of main section 20 as a separate piece, though with little to no gaps between the two. However, for fabrication purposes it is easier to have the bottom 28 and main section 20 as a single piece. A similar arrangement is seen with the bottom 34 of toe piece 30. By virtue of the separation of main section 20 from toe section 30, a flexibility is imparted to the bootie 100, allowing a user to walk with relative ease (due to flexing at the separation space 14).

Figure 2:
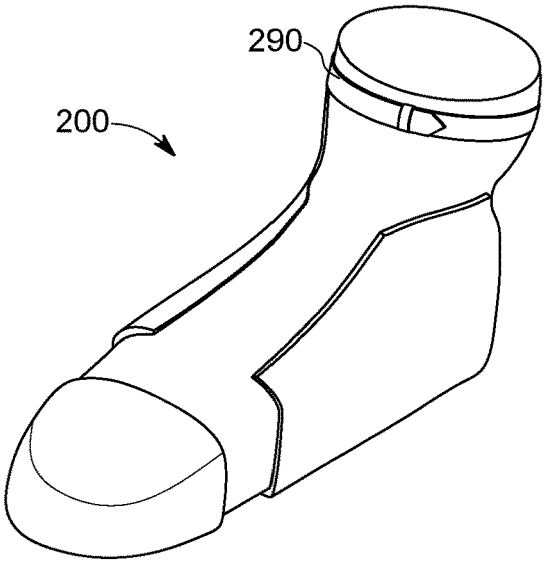
FIG. 2 is a perspective view of the embodiment of FIG. 1A with an upper tightening ankle strap.
Figure 3A:
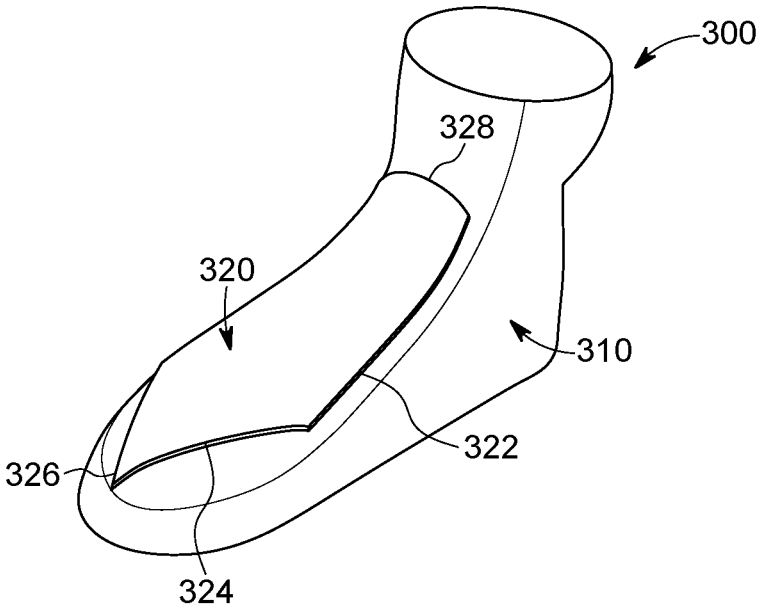
FIG. 3A is perspective view of another exemplary bootie embodiment.
Figure 3B:
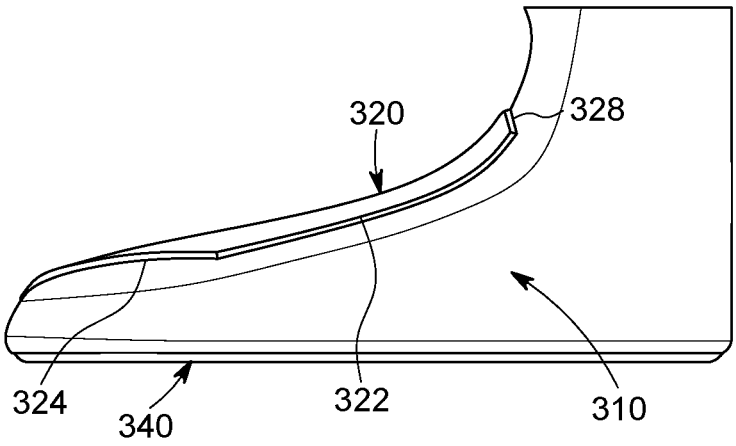
FIG. 3B is a left side view of the exemplary bootie embodiment of FIG. 3A.
Figure 3C:
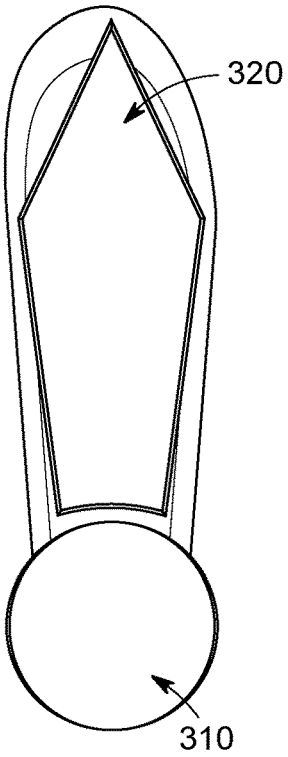
FIG. 3C is a top view of the exemplary bootie embodiment of FIG. 3A.
Figure 3D:
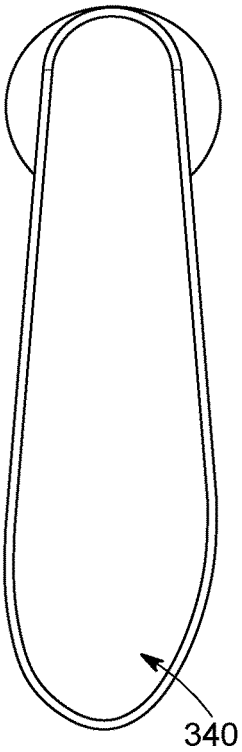
FIG. 3D is a bottom view of the exemplary bootie embodiment of FIG. 3A.

FIG. 2 is an illustration of a prototype mock-up 200 of the bootie embodiment 100 shown in FIG. 1. However, this embodiment 200 includes a fastening strap 290 (A conventional means for fastening can be via a hook & fastener combination such as found in Velcro® Brand which is a registered trademark of Velcro IP Holdings LLC.) Of course, other means well known in the art are also possible, non-limiting examples being buckles, zippers, buttons, laces, and so forth. The elastic strap 290 at the top tightens around the ankle to reduce water ingress as the user moves their foot through the water. This prevents billowing of the material, and thus reduces drag from the water.

FIGS. 3A-D and 4A-D will be used in the following discussion to describe two possible embodiment types where the protection is formed from two different layers. A first embodiment type has a single bootie with a protective layer(s) having designated shapes/locations on the interior side of the bootie and another protective layer(s) having a different designated shape/location on the exterior side of the same bootie. Thus, these two protective layers, by virtue of their "overlap," provides coverage for protection, but also by virtue of their "separation," provides flexibility of the bootie and comfort.

A second embodiment type is one where there are two separate booties, worn over each other. Each of the two booties have a shape/location of protective layer(s), but each shape/location is different. In essence, in this second embodiment type, the overall pattern of the two layers is segregated onto two booties, versus the first embodiment type's one bootie approach. It is understood, the segregation of the protective layers across multiple booties can be extended to more than two booties, if so desired. And, therefore, while the following description of the second embodiment speaks of two booties, it is understood that three or more booties may be utilized without departing from the spirit and scope of this disclosure.

Referring now to the first embodiment type of a single bootie with dual layers, FIGS. 3A-D can be interpreted to represent an inner bootie layer view (the bootie is understood in this example as shown inside out) and FIGS. 4A-D can be interpreted to represent the same bootie but from an outer view perspective showing the outer layer. The protection in the two layers have a different scope of coverage, but when combined are designed to still leave predetermined gaps that only contain flexible material—thus providing comfort and ease of wear as per the non-primary risk areas, while the layers provide sufficient protection over the primary risk areas.

Specifically, as seen in FIGS. 3A-D, inner bootie view 300 and has rubber sections 320 and 340 on the top of the foot and the bottom of the foot, respectively. Top section 320 is bounded by top boundary 328, side boundary 322, front symmetrical boundary 324 and end boundary 326. The top section 320 principally protects the top of the arch and toes, while bottom section 340 protects the sole of the foot. These boundaries are such that they nearly match (nearly abut or extend into or carry over) the boundaries of the outer bootie 400 rubber section 420 seen in FIGS. 4A-D. The bottom section 340 of inner bootie view 300 is also covered from end to end, with rubber to provide sole protection. The non-rubber covered section(s) 310 are principally, but not necessarily, in the lateral sections of the inner bootie view 300 and the upper shank of the inner bootie view 300. It is noted that the top section 320 covers a part of the foot that is tender-skinned (as compared to the sole) and that does not encounter much if any motion (arch) and therefore rubbing of the top layer on the foot area, when the bootie is worn, is minimized. The desire to minimize rubbing of the person's foot by the top section 320 is a valuable factor in considering the size, shape and location for the top section 320, as seen in the particular dimensions of the top section 320. Of course, it is understood that there can be changes, variations to the size, shape and location of the top section 320, that can further reduce potential rubbing, if so desired. Such modifications are understood to be within the spirit of this disclosure. For example, only a portion of top section 320 may be positioned on the inside of the bootie 300, with another portion positioned on the outside layer, if so desired.

Figure 4A:
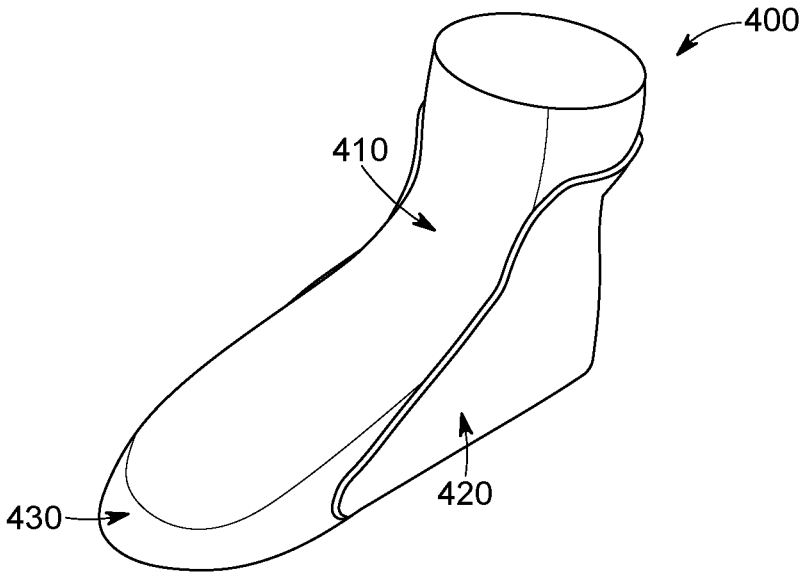
FIG. 4A is perspective view of an exterior of the exemplary bootie embodiment of FIG. 3A and alternately, a second exemplary bootie embodiment.
Figure 4B:
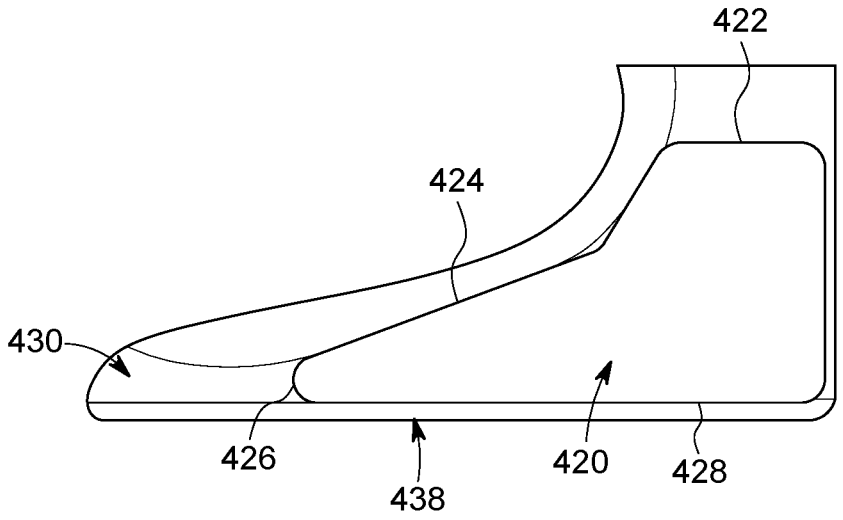
FIG. 4B is a left side view of the exterior of exemplary bootie embodiment of FIG. 3A and alternately, an outer exemplary bootie embodiment.
Figure 4C:
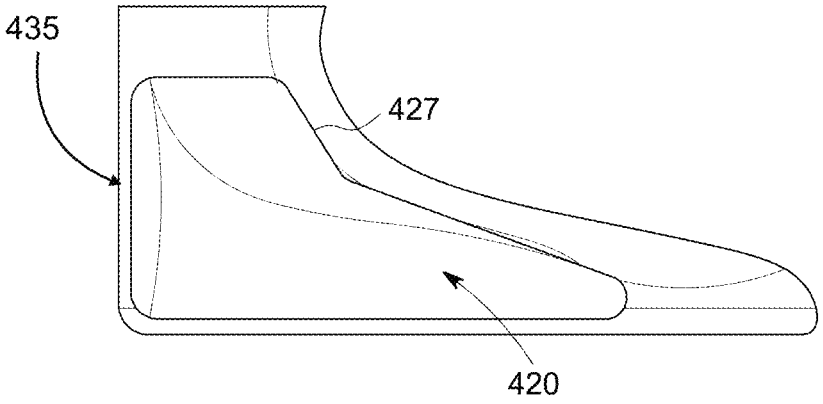
FIG. 4C is a right side view of the exterior of exemplary bootie of FIG. 3A and alternately, an outer exemplary bootie embodiment.
Figure 4D:
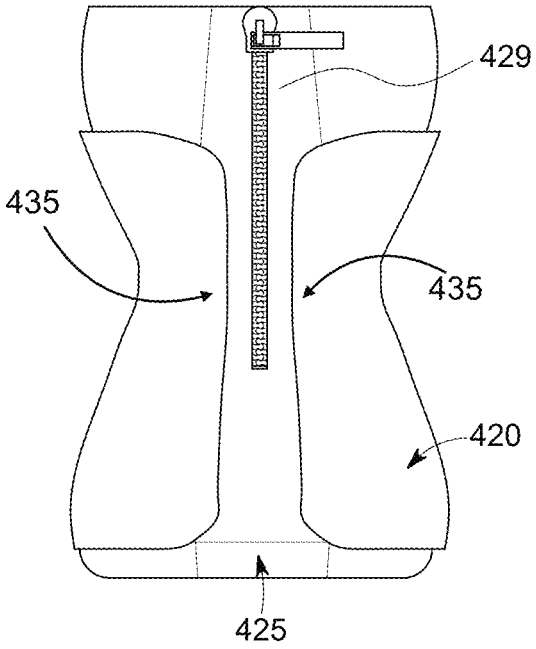
FIG. 4D is a rear view of the exterior of exemplary bootie of FIG. 3A and alternately, an outer exemplary bootie embodiment.

Now referring to FIGS. 4A-D, in the context of the single bootie embodiment, outer bootie view 400 has side rubber sections 420 covering the sides of the foot (which were exposed in inner bootie view 300). Side sections 420 are bounded by top boundary 422, arch boundary 424, toe boundary 426, rear Achilles tendon boundary 435, and sole boundary 428. Stated differently, the side section 420 from the ankle extends toe-ward and terminates proximal to the toe boundary 426, and from the ankle extends heel-ward and terminates proximal to the heel or sole boundary 428, and from the ankle extends towards a top of the foot and terminates proximal to the top of the arch boundary 424, and from the ankle extends reward to the back of the foot, near the Achilles heel to Achilles tendon boundary 435. The Achilles tendon boundary 435 borders the Achilles tendon and therefore is substantially uniform along its height. Top of arch section 410 is not covered in this outer bootie view 400, noting it is covered in the inner bootie view 300 of FIGS. 3A-D. The top boundary 422 can be singular or multi-shaped as indicated in FIG. 4C's 427 boundary. The Achilles tendon boundary 435 is substantially linear from its top to its bottom, uniform along the rear edge of the side rubber sections 420 and when compared to the mirrored matching side rubber section 420, is seen as substantially parallel to the opposing Achilles tendon boundary 435. Thus, the parallel arrangement at the rear of the bootie, provides a near uniform separation 425 between the two side rubber sections 420 as defined by the Achilles tendon boundaries 435. The rear view of the outer bootie view 400 is shown in FIG. 4D wherein the side sections 420 are separate from each other, to provide the nearly uniform (substantially parallel) separation 425 for articulation of the Achilles' tendon. In some embodiments, this separation 425 may be complemented with a zipper 429, opening the separation 425 to the top of the bootie to provide easier ingress of the foot into the bootie. Understandably, having the Achilles tendon boundary 435, not significantly vary from top-to-bottom, ensures stingray barb strike protection all the way up the rear sides of the ankle.

Both inner and outer layers in a prototyped embodiment were vulcanized with the underlying bootie stretched over a shoe last of the appropriate size and shape, but the rubber is molded to the outer layer when the bootie is inside out. Thus, when it is turned inside out, the rubber on the second layer turns inward and is hidden from sight, between the two layers.

In the dual bootie embodiment, where there are two separate booties worn over each other, FIGS. 3A-D can be interpreted to also show an exterior view of a first "inner" (or conversely "outer") bootie to be worn. FIGS. 4A-D then can be interpreted to illustrate the protective layer(s) for the second "outer" (or conversely "inner") bootie to be worn. The same explanation regarding the protective layer(s) provided above for the dual-layer, single bootie example, can be applied to the description of this two-bootie embodiment. As suggested above, the order of the dual bootie wearing can be changed in some embodiments and may depend on the choice of comfort by the user.

The layered, double bootie approach is functionally similar to the single-layered, single bootie embodiment 100, and the two layered-single bootie example, except that the coverage of the foot with vulcanized rubber is spread across two booties having layers. Both layers are bonded to an underlying neoprene bootie, wherein the neoprene and/or vulcanized rubber can be thinner than that of the single-layered bootie 100 (to avoid excessive warmth/bulkiness), and the vulcanized rubber layers can then spatially "mesh" when the booties are combined to cover the desired risk area.

Importantly, the two booties are not actively fastened to one another—they move independently. Additionally, depending on the implementation, each bootie can be approximately half covered in rubber, so to still retain a significant ability to stretch. By virtue of friction, when the inner bootie is placed inside the outer bootie, the two bootie embodiment can be worn as a single piece of footwear. That is, the user can put on the two bootie embodiment in one motion (inner bootie fitting within outer bootie) if the fit is sufficiently loose, or one bootie a time, if the fit is tight.

The double-layered construction (either in bootie and/or protective layers) allows significant ability for the bootie(s) to stretch to different foot shapes and sizes, while still covering a very significant portion of the area at risk for stingray injury.

Figure 5:
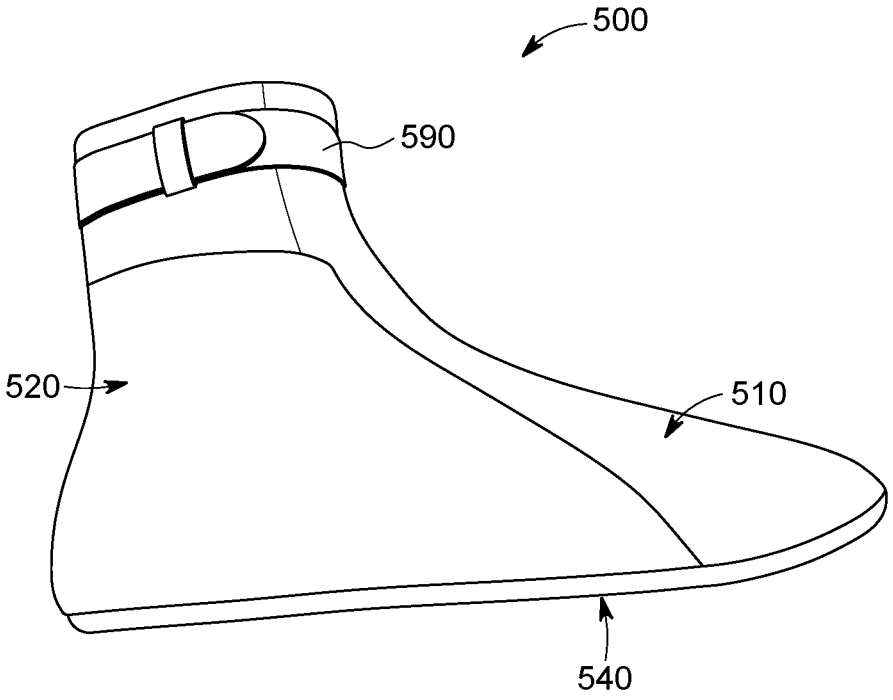
FIG. 5 is an illustration of another example of FIG. 4A-D's embodiment, with an upper tightening ankle strap.

FIG. 5 is an illustration of another example of FIG. 4A-D's embodiment, but with slight variation in the shape and size of side protective section 520 and with the addition of a fastening strap 590 in continuity with the underlying fabric/neoprene 510. The sole of the bootie 540 is shown here as separate feature and can be of the same material as 510 or can be an additional protective layer, if so desired.

Additional embodiments will be apparent to artisans. For example, in the above embodiments, the amount of the gap portions in the pattern of the protective material can be varied to suit different risks/usages. While stingray protection is a goal, preferred footwear can have overall protection, flexibility and comfort tradeoffs based upon intended usage. E.g., diving booties can have stiffer, thicker rubber, especially in the sole, because less flexibility is required for diving, and for walking on sharp rocks, reefs, sea urchins, etc.—suggests much thicker on bottoms, more stretch in other areas. Puncture-resistant shin/ankle guards are a form of footwear for water use. Protect from fish like stingrays, scorpion fish, stonefish, sculpin, water snakes, etc. Similarly, puncture-resistant footwear can provide shin guards for out-of-water use, to protect users from snake bites and similar.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A flexible, stingray barb strike protective water sport footwear, comprising:

a stretchy, flexible material formed as a bootie configured to cover an entirety of a person's feet and ankles when worn; and a plurality of puncture resistant, non-stretchy protective materials shaped in a pattern, the pattern attached a medial side of the bootie and a matching pattern attached to a lateral side of the bootie, the attached patterns configured to provide protection of a majority of the person's at least one medial and lateral sides of their foot, the attached patterns configured from the ankle extending toe-ward and terminating proximal to the toes, and configured to extend heel-ward from the ankle and terminate proximal to the heel, and configured to extend upward from the ankle extending towards a top of the foot and terminating proximal to above the foot, and configured to extend rear-ward and terminating proximal to the Achilles heel and forming a linear rear edge;

separations between the attached patterns the separations adapted to extend from a top of the person's toes to the top of the foot, and along the person's Achilles tendon, being substantially uniform from a bottom of the heel to above the ankle; and at least one of a zipper disposed in the separation configured along the person's Achilles tendon and a fastening strap attached to an upper portion of the bootie, wherein the plurality of puncture resistance, non-stretchy protective materials in the attached patterns is configured to protect against a stingray barb.

2. The footwear of claim 1, wherein the flexible material is approximately between 1.5 mm-7 mm in thickness.

3. The footwear of claim 1, wherein the flexible material is made of neoprene.

4. The footwear of claim 1, wherein the protective materials are made of vulcanized rubber or nylon and are between 2-3 mm in thickness.

5. The footwear of claim 1, wherein the protective materials are liquid in form prior to attachment, wherein the protective materials harden after attachment.

6. The footwear of claim 1, wherein the protective materials are vulcanized upon attachment.

7. The footwear of claim 1, wherein the pattern is applied to a plurality of booties.

8. The footwear of claim 1, wherein the protective materials in the pattern are not fastened to one another and can move independently of one another.

9. The footwear of claim 1, further comprising sleeves in the bootie, wherein the protective materials is attached to the bootie as an insert into the sleeves of the bootie.

* * * * *